US005188552A

United States Patent [19]

Keyvani

[11] Patent Number: 5,188,552

[45] Date of Patent: Feb. 23, 1993

[54] SWIMMING AID

[76] Inventor: Daryoush Keyvani, 321 S. Sherbourne Dr., No. 109, Los Angeles, Calif. 90048

[21] Appl. No.: 598,481

[22] Filed: Oct. 8, 1990

[30] Foreign Application Priority Data

Jun. 22, 1990 [IL] Israel ..... 94849

[51] Int. Cl.[5] ..... A63B 31/00; B63C 9/13

[52] U.S. Cl. ..... 441/116; 441/129

[58] Field of Search ..... 441/106–119, 441/129; 114/315

[56] References Cited

U.S. PATENT DOCUMENTS

| | | | |
|---|---|---|---|
| 635,069 | 10/1899 | Angevine | 441/114 |
| 3,061,847 | 11/1962 | Gorham | 441/114 |
| 3,065,888 | 11/1962 | Lande | 405/186 |
| 3,842,611 | 10/1974 | Anderson | 405/186 |
| 4,047,255 | 9/1977 | Kiefer | 441/106 |
| 4,496,328 | 1/1985 | Asher et al. | 441/108 X |
| 4,779,554 | 10/1988 | Courtney | 441/116 X |
| 4,936,805 | 6/1990 | Piatt, Jr. | 441/106 |

*Primary Examiner*—Sherman Basinger
*Attorney, Agent, or Firm*—Lawrence S. Cohen

[57] ABSTRACT

A swimming aid including a lower torso buoyancy device to be worn by the user which will impart buoyancy to the lower torso of the user. The lower torso buoyancy device is attached to and part of a rigid frame which is held onto the back of the user particularly at the lower torso and at the shoulders to enable the lower torso to be lifted and oriented to place the user in a good position for swimming.

21 Claims, 4 Drawing Sheets

SWIMMING AID

BACKGROUND

Field of Invention

The present invention concerns a swimming aid for use by persons who swim in man made bodies of water, in rivers, lakes or the sea.

Discussion of Related Art

A number of flotation devices are known for use by swimmers, practically all of which are simply floats which prevent a person from sinking and possibly drowning and which have the drawback of hindering free movement of a swimming person.

SUMMARY OF THE INVENTION

The center of gravity of a human body in water is shifted to the lower portion of the body because of the specific gravity of the lungs. Existing flotation devices increase the buoyancy of the upper part of the body causing the body to be maintained in essentially a vertical position.

It is the object of the invention to provide a device which while acting as a float does permit free movement of a swimmer's arms and legs. The primary advantage of the swimming aid is to readjust the center of gravity of a body in water to the midsection of the body which makes it easier for a swimmer to maintain a horizontal position in the water.

Existing flotation devices attach to the widest part of the body and have a large surface area which dramatically increases the surface resistance to movement in water. An additional advantage of the present invention is that it provides a buoyancy equivalent to the inventions in the prior art, but with a hydrodynamically designed shape which lessens the surface resistance of the device. This allows a person wearing the swimming aid to proceed through the water with greater ease and speed compared to a swimmer wearing various existing flotation devices.

The invention is particularly useful in aiding long distance swimmers by increasing their buoyancy and maintaining their horizontal position in the water thereby reducing the amount of energy which has to be expended in order to proceed in the water to reach a distant target point. The swimming aid allows the swimmer to rest when becoming tired.

Another advantage of the device is its use as an aid in teaching persons how to swim because the support the swimming aid gives to the body and the absence of any danger of sinking helps to alleviate the beginner's anxiety. An additional advantage is that the device will be useful in hydrotherapy in supporting the patient's body in the water and making therapeutic manipulations easier.

According to the invention the new device comprises a vest fabricated from a flexible material comprising front and rear sections with an aperture the edges of which, when the swimming aid is worn, extend around the neck of the wearer. Upper and lower crosswise extending stiffening members extend outward from a downward extending rod. A float extends from the lower end of the rod said float being angularly disposed to the longitudinal axis of said rod. The back of the vest is connected to the upper section of the upper crosswise extending stiffening member by quick releasing connecting means. Straps attached to the side sections of the upper crosswise extending stiffening member extend under the armpits and are connected to straps attached on the front sides of the vest by quick releasing connecting means securing the vest to the upper body. Straps attached to the side sections of the lower crosswise extending stiffening member are connected to straps attached to the front sides of the vest at waist level by quick releasing connecting means securing the vest to the midsection of the body. Straps attached to the lower section of the lower crosswise extending stiffening member pass between the legs under the crotch of the wearer and are connected to straps on the lower front section of the vest by quick releasing connecting means firmly securing the swimming aid to the body.

DESCRIPTION OF THE PREFERRED EMBODIMENTS

Figure 1:
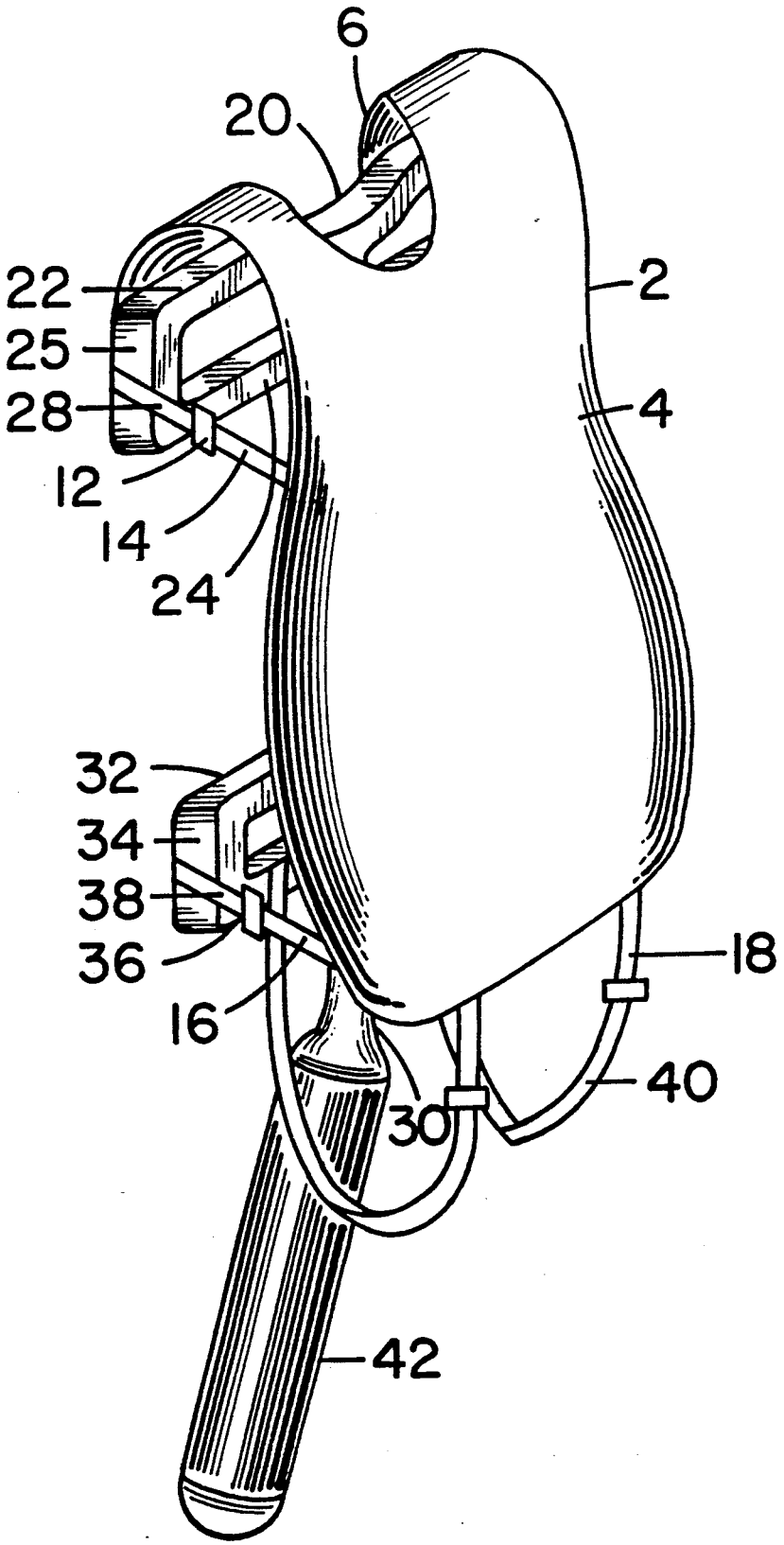
FIG. 1 is a perspective view of the swimming aid.

Referring now to the drawings the primary embodiment and best mode for carrying out the invention is shown in FIG. 1 in a perspective view.

Figure 2:
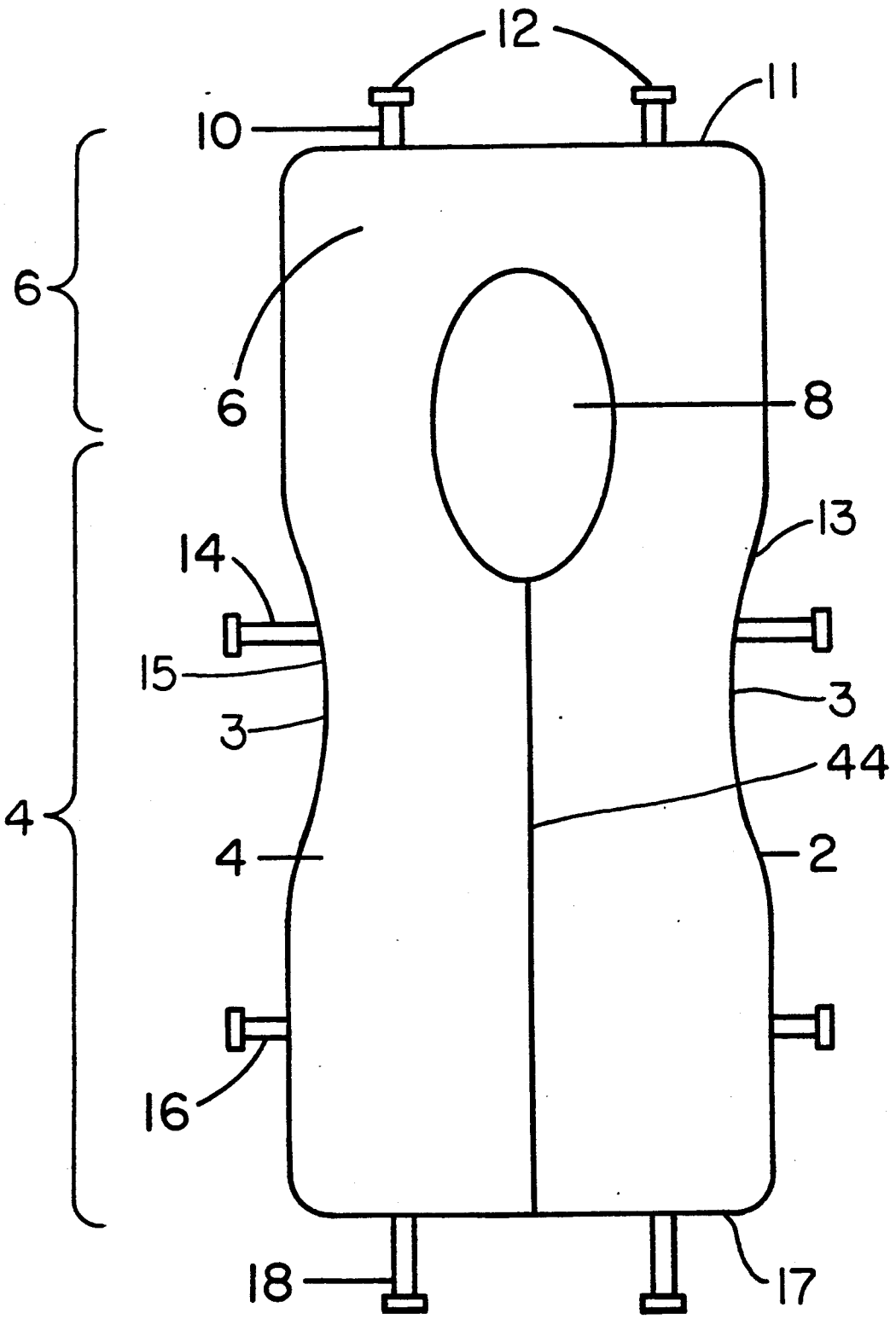
FIG. 2 is a plan view of the vest.

FIG. 2 shows a plan view of vest 2 of a generally rectangular shape cut inward in an arcuate pattern 3 where the vest lies over the shoulders of the wearer said vest 2 being fabricated from a flexible material. The material is folded double to form longer front section 4 which extends to the waist and shorter rear section 6 which extends to just below the shoulders. An oblong section is cut from the material near the end forming aperture 8 through which the head of the wearer is inserted. Pairs of straps are sewably attached to the edges of vest 2 on front section 4 and rear section 6. Quick releasing connecting means 12 are attached to the free ends of each strap.

Vertical back straps 10 are attached to vest 2 at the lower edge 11 of rear section 6 over the right and left shoulders. Lateral upper body straps 14 are attached to the right side edge 13 and left side edge 15 of front section 4 of vest 2 just under the arm pits. Lateral waist straps 16 are attached to the right side edge 13 and left side edge 15 near the bottom of front section 4.

The stiffening member 20 is designated the upper stabilizing means; the stiffening member 32 is designated the lower stabilizing means; the rod 30 extending between the upper stabilizing member 20, the lower stabilizing member 32 and the buoyancy device 42 rigidly connects these elements. Vertical crotch straps 18 are attached at both sides of the lower edge 17 of front section 4.

Figure 3:
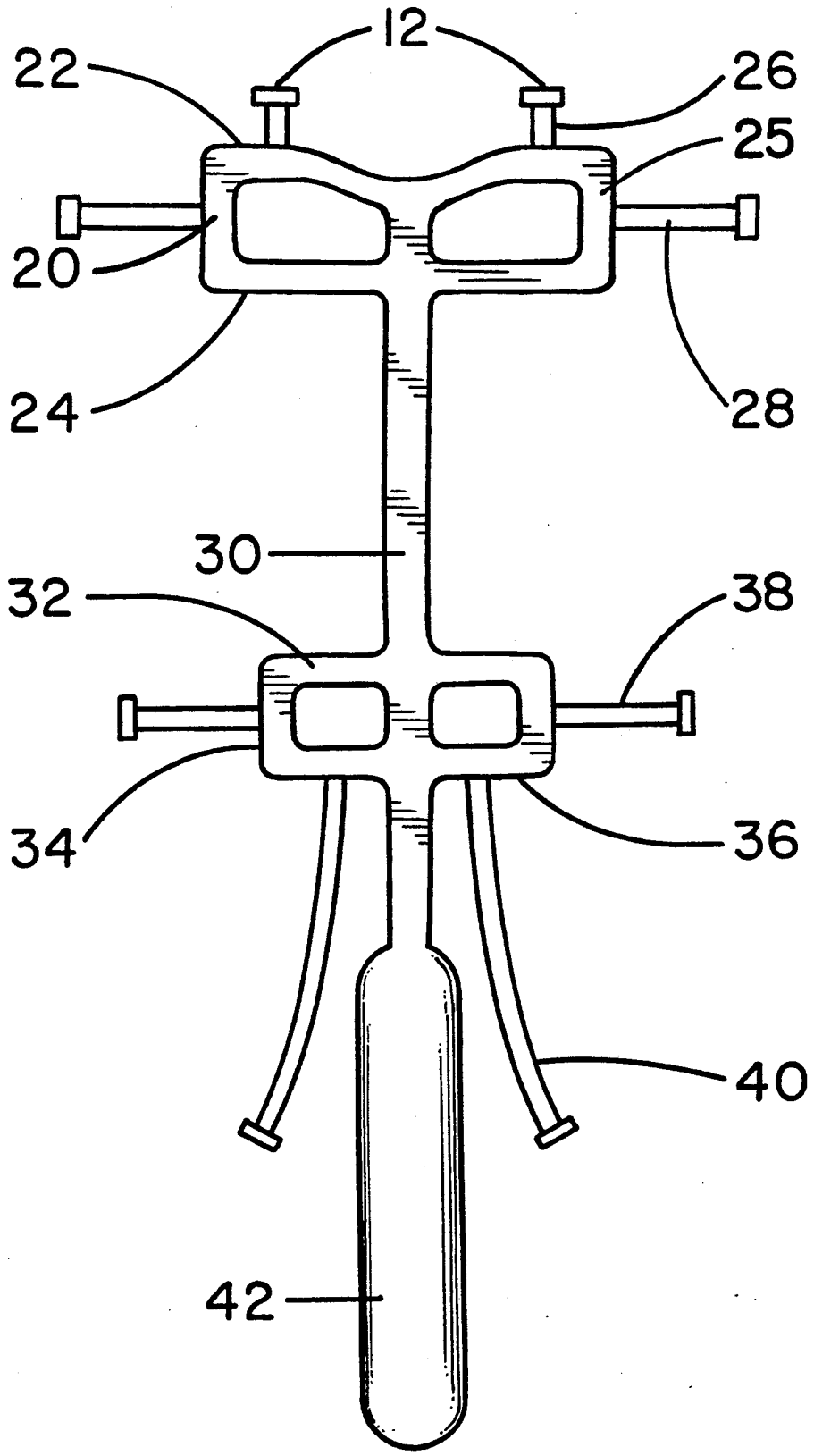
FIG. 3 is a plan view of the upper and lower crosswise extending stiffening members, the attached straps, the rod and the attached float.

FIG. 3 is a plan view showing the attachment of upper and lower crosswise extending stiffening members 20 and 32 and float 42 to rod 30. Downward extending rod 30 is attached to upper crosswise extending stiffening member 20. Lower crosswise extending stiffening member 32 is attached to rod 30. Float 42 is attached at the lowermost end of rod 30. Crosswise extending stiffening members 20 and 32, rod 30 and float 42 may be conveniently fabricated from low density metal, plastic or wood.

Upper crosswise extending stiffening member 20 has a generally rectangular shape comprising two U shaped structures attached to rod 30. The length of the longer side is the shoulder width of an average human torso; the length of the shorter side is about one third the length of the longer side. The upper horizontal section 22 of upper crosswise extending stiffening member 20 is straight for a short distance from the outer edge then curved slightly downward to the center. The lower horizontal section 24 of upper crosswise extending stiffening member 20 is straight. The inside surface of upper crosswise extending stiffening member 20 may be padded for comfort. Vertical back straps 26 with quick releasing connecting means 12 at the free ends are securely attached at shoulder width to upper horizontal section 22 of upper crosswise extending stiffening member 20. Lateral upper body straps 28 with quick releasing connecting means 12 at the free ends are securely attached to the right and left side sections 25 of upper crosswise extending stiffening member 20.

The lower crosswise extending stiffening member 32 has a proportionally smaller rectangular shape than upper crosswise extending stiffening member 20 comprising two U shaped structures attached to rod 30. Lateral waist straps 38 with quick releasing connecting means 12 at the free ends are securely attached to the right and left side sections 34 of lower crosswise extending stiffening member 32. Vertical crotch straps 40 with quick releasing connecting means 12 at the free ends are securely attached to lower section 36 of lower crosswise extending stiffening member 32.

Figure 4:
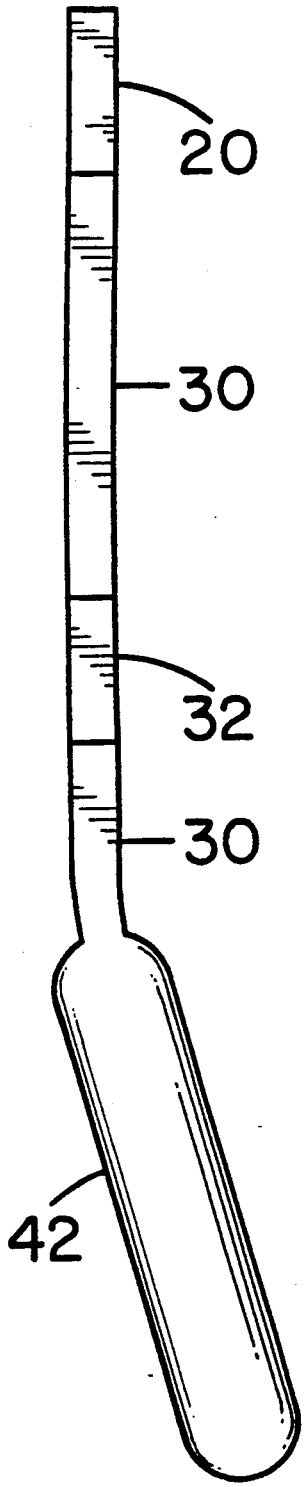
FIG. 4 is a side view of the upper and lower crosswise extending stiffening members, the rod and the attached float.

FIG. 4 is a side view of upper and lower crosswise stiffening members 20 and 32, rod 30 and float 42 showing float 42 disposed angularly to the longitudinal axis of rod 30 whereby float 42 does not interfere with the leg motion of a swimmer. Float 42 comprises a hollow cylinder rounded at the end. Float 42 may be filled with a buoyant gas or with a low density buoyant solid filler.

In using the swimming aid back straps 10 and 26 are connected by quick releasing connecting means 12 thereby connecting vest 2 to upper crosswise extending stiffening member 20. The wearer places the head through aperture 8 and connects lateral upper body straps 14 and 28 by quick releasing connecting means 12 securing the swimming aid to the upper body. Lateral waist straps 16 and 38 are connected by quick releasing connecting means 12 securing the swimming aid to the mid section of the body. Upper crosswise extending stiffening member 20 rest against the back just below the shoulders and lower crosswise extending stiffening member 32 rests on the lower back. Vertical crotch straps 40 are passed between the legs under the crotch and connected to vertical crotch straps 18 by quick releasing connecting means 12 firmly securing the swimming aid to the body of the wearer. The swimmer may now enter the water and swim safely with the knowledge he will not sink or be in danger of drowning.

In another embodiment front section 4 of vest 2 is divided longitudinally down the center from the front edge of orifice 8 to the lower edge of front section 4. The edges formed by said division are releasably connectable, for example by a zipper as shown at 44 in FIG. 2.

The invention being thus described it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A swimming aid to be worn on the body of a person comprising:

a vest fabricated from a flexible material comprising a front and rear section the front section having a lower edge and side edges and the rear section having a lower edge and side edges;

an aperture formed in the center of said material the circumferential edge of which when said vest is worn extends around the neck of the wearer whereby the front section will extend along the front of a person's torso and the rear section will extend along the rear of a person's torso;

a plurality of strap like connecting means attached to said vest in pairs, a first pair of straps extending from the lower edge of the rear section of said vest proximate the shoulder blade location of an average human torso, a second pair of straps extending from the side edges of the front section just below said aperture of said vest, a third pair of straps extending laterally from the side edges of the front section proximate the bottom of said vest, a fourth pair of straps extending vertically from the lower edge of the front section of said vest;

a downward extending rod defining a longitudinal axis for placement longitudinally at the back of a person's torso;

an upper crosswise extending stiffening member generally rectangular in shape formed of two U shaped structures attached to the top of said rod, each U shaped structure defining for its longer sides an upper horizontal bar, and a lower horizontal bar and for its shorter side a side bar at each end joining the upper horizontal bar and the lower horizontal bar the longer side of said rectangle having a length the shoulder width of the average human torso, the shorter side of said rectangle being approximately one third the length of the longer side;

a plurality of strap connecting means attached to the upper horizontal bar and the side bars of said upper crosswise extending stiffening member, for attachment to said first pair of straps and said second pair of straps;

a lower crosswise extending stiffening member, comprising a proportionally slightly smaller rectangular shape than said upper crosswise stiffening member, formed of two U shaped structures attached to said rod at a distance from the top of said rod such that said member is just above the buttocks of the wearer each U shaped structure defining for its longer sides an upper horizontal bar and a lower horizontal bar and for its shorter side a side bar at each end joining the upper horizontal bar and the lower horizontal bar;

a plurality of strap connecting means attached to the side and lower horizontal bars of said lower crosswise extending stiffening member, for attachment to said third pair of straps and said fourth pair of straps;

said straps and strap connecting means having quick releasing connecting means;

a hollow buoyant float attached at the lowermost end of said rod said float being angularly disposed to the longitudinal axis of said rod.

2. A swimming aid as claimed in claim 1, wherein said hollow float is filled with a buoyant gas.

3. A swimming aid as claimed in claim 1, wherein said hollow float is filled with a low density buoyant solid filler.

4. A swimming aid as claimed in claim 1, wherein said front section of said vest is divided down the center by a longitudinal cut defining mating edges extending from the edge of said aperture to the lowermost edge of said front section the mating edges of said cut being releaseably attached.

5. A swimming aid to be worn on the body of a person comprising:

a lower torso buoyancy device attachable to the back of a person's lower torso having a lower stabilizing member for placement proximate a person's lower torso and being a rigid member extending substantially across the body of the user and a buoyancy device being a rigid member rigidly attached to the lower stabilizing member and extending below the lower stabilizing member and the buoyancy device being attached to a person's body by means for attaching the lower stabilizing member to the lower portion of a person's torso whereby buoyancy is imparted to the lower torso to enable a more effective swimming position.

6. The device of claim 1 wherein the vest is buoyant and the rear section of the vest is substantially shorter than the front section of the vest.

7. The swimming aid of claim 5 wherein the lower torso buoyancy device further comprises an upper stabilizing member for placement proximate a person's shoulders and means rigidly connecting the upper stabilizing member, the lower stabilizing member and the buoyancy device and means for maintaining the upper stabilizing member proximate a person's shoulders.

8. The swimming aid of claim 7 further comprising a flotation vest to be worn on the body of a person having at least in part a portion worn on the front of the person's torso and means for the vest to be maintained in place on the person's body.

9. The swimming aid of claim 8 wherein:

the means for attaching the lower torso buoyancy device comprises means for attaching the upper stabilizing member to the flotation vest at an upper area thereof and the means for attaching the lower stabilizing member to the lower portion of a person's body is means for attaching the lower stabilizing member to the flotation vest at a lower area thereof.

10. The swimming aid of claim 9 wherein the means for attaching the upper stabilizing member to the flotation vest is flexible elongate members extending from the vest to the upper stabilizing member and the means for attaching the lower stabilizing member to the vest is flexible elongate members extending from the vest to the lower stabilizing member.

11. The swimming aid of claim 10 wherein the buoyancy device is an elongate member defining an elongate dimension having its long dimension extending downwardly of a person's body and being angled away from the person's body along its elongate dimension.

12. The swimming aid of claim 11 wherein the upper stabilizing member is a rigid beam having a width dimension to traverse the upper back of a person proximate the person's shoulders and the lower stabilizing member is a rigid beam having a width dimension to traverse the lower back proximate the lower torso of a person and the flexible elongate members for attaching are upper straps extending from ends of the upper stabilizing member to the vest and lower straps extending from the lower stabilizing member to the vest.

13. The swimming aid of claim 12 wherein the upper straps comprise a pair of straps extending vertically and a pair of straps extending laterally and the lower straps comprise a pair of straps extending laterally and a pair of straps extending vertically.

14. The swimming aid of claim 13 wherein said vest is divided down the center and is releasably attached along the division.

15. A swimming aid to be worn on the body of a person comprising;

a lower torso buoyancy device attachable to the back of a person's torso having a lower stabilizing member for placement proximate a person's lower torso and being a rigid member extending substantially across the body of the user and;

a buoyancy device being a rigid elongate member rigidly attached to the lower stabilizing member to form therewith a single rigid structure the buoyancy device having its long dimension extending downwardly of a person's body below the lower stabilizing member and being angled away from the person's body along its elongate dimension and means for attaching the lower stabilizing member to the lower portion of a person's torso whereby buoyancy of the buoyancy device will act on the lower stabilizing member to orient the torso into a comfortable position.

16. The swimming aid of claim 15 further comprising an upper stabilizing member being a rigid member having a width dimension to traverse the upper back of a person proximate the person's shoulders and rigid means connecting the upper stabilizing member and the lower stabilizing member whereby buoyancy of the buoyancy device will act on the lower and upper stabilizing members to orient the torso into a comfortable swimming position.

17. A swimming aid to be worn on the torso of a person comprising:

a buoyant member adapted to be located substantially below the hips of a user and to the rear of the user's body;

a stabilizing member adapted to be attached to the torso of a user above the hips;

the buoyant member and the stabilizing member being rigidly interconnected;

whereby buoyancy action of the buoyant member is transmitted to the user's body to urge the user's body toward a generally horizontal swimming position.

18. The swimming aid of claim 17 in which the stabilizing member is located at the back of the user's body.

19. The swimming aid of claim 18 wherein the stabilizing member comprises a lower stabilizing member near the user's lower torso and an upper stabilizing member spaced upwardly of the torso from the lower stabilizing member, the lower and upper stabilizing members being rigidly connected.

20. The swimming aid of claim 18 further comprising a second buoyancy device adapted to be attached to the upper front portion of the user's torso to provide buoyancy to the torso.

21. The swimming aid of claim 20 wherein said second buoyancy device is made of flexible material and is worn on the upper torso of the user.

* * * * *